US008276788B2

(12) United States Patent
Lyda

(10) Patent No.: US 8,276,788 B2
(45) Date of Patent: Oct. 2, 2012

(54) METHOD AND APPARATUS FOR HEATING PRODUCTS DISPENSED FROM A CONTAINER

(76) Inventor: Lance Lyda, Southlake, TX (US)

( * ) Notice: Subject to any disclaimer, the term of this patent is extended or adjusted under 35 U.S.C. 154(b) by 877 days.

(21) Appl. No.: 12/400,296

(22) Filed: Mar. 9, 2009

(65) Prior Publication Data

US 2010/0224345 A1 Sep. 9, 2010

(51) Int. Cl.
*B67D 7/80* (2010.01)
*B67D 7/76* (2010.01)
*B65D 83/00* (2006.01)

(52) U.S. Cl. ..... 222/146.3; 222/402.13; 222/189.11

(58) Field of Classification Search ..... 222/146.3, 222/146.2, 146.1, 402.13, 402.2, 402.1, 153.11, 222/153.1, 153.13, 153.14, 635, 636, 450, 222/452, 424.5, 444, 448, 205, 189.07, 189.06, 222/189.11, 1

See application file for complete search history.

(56) References Cited

U.S. PATENT DOCUMENTS

| | | | |
|---|---|---|---|
| 3,062,416 | A | 12/1958 | Cooprider |
| 3,175,733 | A | 3/1965 | Lerner |
| 3,184,114 | A | 5/1965 | Minear |
| 3,217,937 | A | 11/1965 | Kasparian |
| 3,241,724 | A | 3/1966 | Lerner |
| 3,258,170 | A | 6/1966 | Ayres et al. |
| 3,300,095 | A | 1/1967 | Marraffino |
| 3,314,572 | A | 4/1967 | Pungitore |
| 3,338,477 | A | 8/1967 | McKinnie et al. |
| 3,341,079 | A | 9/1967 | Marraffino |
| 3,391,647 | A | 7/1968 | Corsette et al. |
| 3,559,850 | A | 2/1971 | Barkin |
| 3,576,279 | A | 4/1971 | Ayres |
| 3,710,985 | A | 1/1973 | Baum |
| 3,990,612 | A | 11/1976 | Gasser |
| 4,410,107 | A | 10/1983 | Corsette |
| 4,703,875 | A | 11/1987 | Malek |
| 4,913,323 | A | 4/1990 | Schneidel |
| 5,127,556 | A | 7/1992 | Sporri |
| 5,255,823 | A | 10/1993 | Tichy et al. |
| 6,655,552 | B2 | 12/2003 | Aiken et al. |
| 7,387,219 | B2 | 6/2008 | Leick |
| 2005/0072803 | A1 | 4/2005 | Leick |

*Primary Examiner* — Kevin P Shaver
*Assistant Examiner* — Stephanie E Williams
(74) *Attorney, Agent, or Firm* — Grady K. Bergen; Griggs Bergen LLP

(57) ABSTRACT

A method and apparatus for heating a product dispensed from a handheld container having a nozzle for discharging the product from the container utilizes a discharge assembly having a discharge housing that defines a reservoir and is in fluid communication with the nozzle when the discharge assembly is coupled to the container. The reservoir receives the discharged product from the nozzle and collects the discharged product within the reservoir and allows the introduction of a warm liquid into the reservoir. A strainer allows the warm liquid introduced into the reservoir of the discharge housing to be separated from the discharged product by pouring the warm liquid from the discharge housing through the strainer. The strainer is configured to retain majority of the discharged product within the reservoir after pouring out the liquid. A product access port allows the discharged product to be removed from the reservoir of the housing.

20 Claims, 6 Drawing Sheets

METHOD AND APPARATUS FOR HEATING PRODUCTS DISPENSED FROM A CONTAINER

BACKGROUND

This invention relates to methods and apparatus for heating products dispensed from a handheld container, such as shaving gel and the like.

BRIEF DESCRIPTION OF THE DRAWINGS

For a more complete understanding of the present invention, and the advantages thereof, reference is now made to the following descriptions taken in conjunction with the accompanying figures, in which.

DETAILED DESCRIPTION

Figure 1:
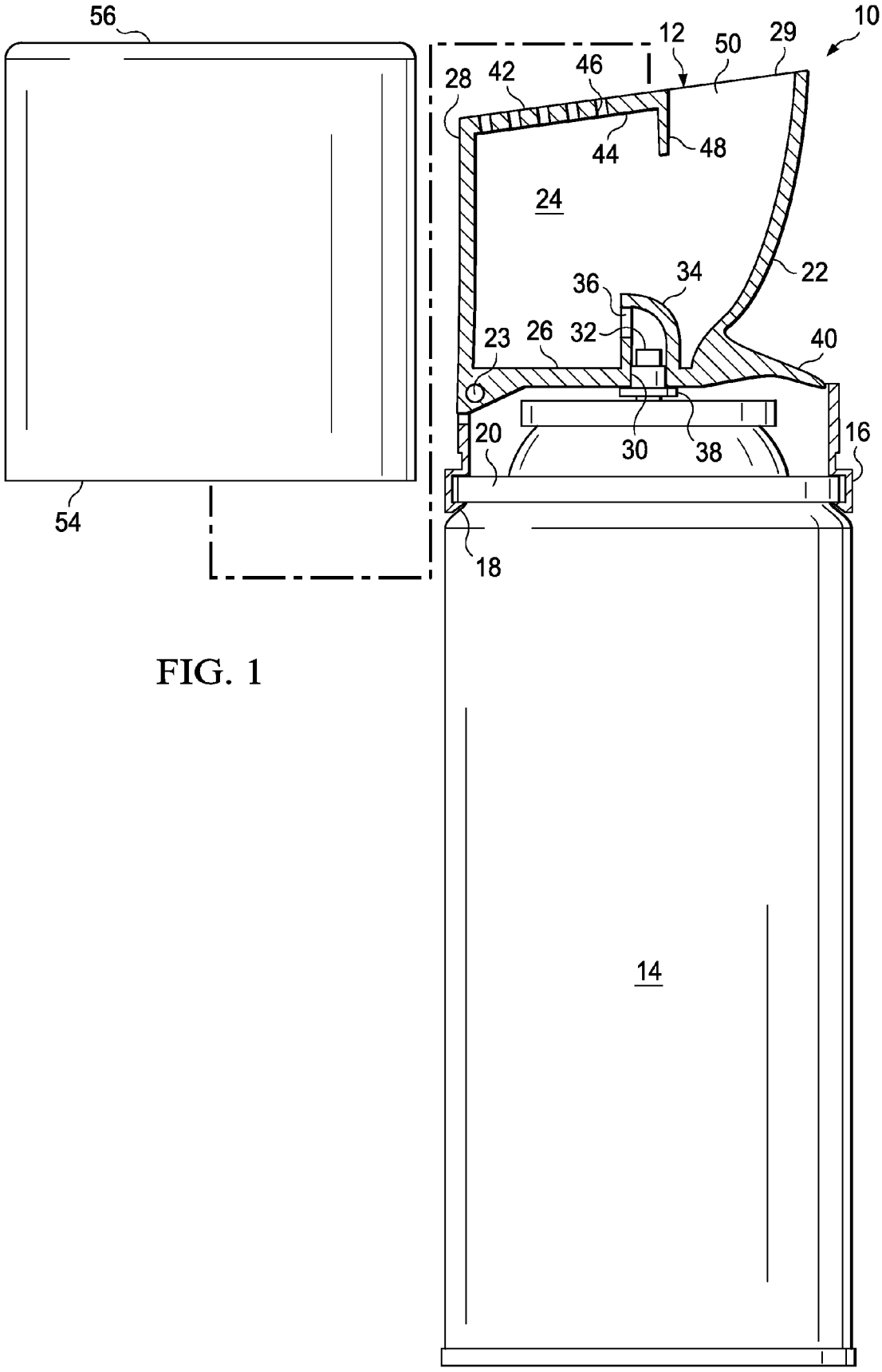
FIG. 1 is an elevational side view of a device for dispensing and warming a product dispensed from the device.

Referring to FIG. 1, a device 10 is shown for dispensing a product. The device 10 includes a discharge assembly 12 and a container 14 for holding and storing the product to be dispensed. The container 14 may be dimensioned to be generally held in one hand as the product is being dispensed, although other dimensions and configurations may be used for the container 14. The container 14 of FIG. 1 is shown as a cylindrical pressurized or aerosol canister containing a compressed gas used as a propellant to facilitate discharging the product. The compressed gas may be those typically used with such aerosol canisters, such as light end hydrocarbons (e.g. propane, butane, etc.), nitrogen, nitrous oxide, carbon dioxide, air, etc. that are contained under pressure within the container 14. Such aerosol canisters are typically constructed of metal, although other suitable materials, such as plastic, may be used as well. Such aerosol canisters may include those that utilize a piston or other mechanism for isolating the pressurized gas propellant from the product being discharged, examples of which are described in U.S. Pat. Nos. 4,703,875; 4,913,323 and 5,127,556, each of which is incorporated herein by reference. In other embodiments, the pressurized propellant gas may be non-isolated from the product so that it is discharged along with the product being dispensed.

Although the device 10 and the other embodiments shown and described herein are configured and make use of pressurized gas propellants, the invention has application to liquid product dispensing devices wherein the product is discharged from a container through a nozzle or opening through other means, such as through a pump or reciprocating plunger mechanism that may be manually operated. Such devices are commonly used in dispensing liquid soap and other liquids. Examples of such devices are described in U.S. Pat. Nos. 3,062,416; 3,391,647; 4,410,107 and 5,255,823, each of which is herein incorporated by reference. The container containing the product could also constitute a squeeze bottle, wherein the container is deformable and functions as a pump when the container is squeezed to increase the pressure within the container to thereby discharge the product through a nozzle or opening of the container. Other means of discharging the product from a container may also be used and are intended to be encompassed by the invention unless indicated otherwise.

The product dispensed from the container 14 may be a liquid product and in particular may be a liquid health, cosmetic or grooming product that is applied to the skin or hair. The dispensed product typically has a fluid viscosity that is substantially greater than that of water or the warming liquid that is used to warm the product, as described herein. In particular the product may be a liquid shaving gel or lotion. Such products may be quite cool, particularly when they are dispensed from a pressurized canister, such as an aerosol canister, wherein the expansion of compressed gases used in propelling the product from the canister results in significantly lowering of the product temperature. When such products are dispensed and immediately applied to the skin they can be very cool and uncomfortable. Even when such products are not dispensed from such pressurized containers or canisters, the temperature of liquid products maintained and dispensed at room temperatures can still be somewhat cool and uncomfortable when applied to the skin. Although the dispensed product is typically a liquid, it may also include solid particulates that have fluid-like characteristics and may include particulates incorporated in a binder material, which may be a liquid. The particulates may be in the form of small capsules or beads that contain a liquid.

The device 10 facilitates heating or warming of the product once discharged from the container 14 so that it may be comfortably applied to the skin. As shown in FIG. 1, the discharge assembly 12 includes a container engagement portion 16 that is configured to secure and engage the upper end of the container 14. The engagement portion 16 may be configured as a collar or sleeve that engages the upper end of the container 14. This may include an inwardly projecting annular lip 18 that engages an outwardly projecting rim or seam 20 of the container 14 in a snap-fit or friction-type engagement. Other engagement mechanisms or methods may also be employed, however.

The discharge assembly 12 also includes a discharge housing 22. The discharge housing 22 may be pivotally coupled to the engagement portion 16, such as through a hinge 23. The hinge 23 may be any suitable hinge, which be a mechanical hinge or may be provided by the flexibility of the materials forming the assembly 12. The discharge housing 22 is configured to define a reservoir 24 for collecting and holding a warming liquid. In the embodiment shown, the reservoir 24 is defined by a floor 26 and sidewalls 28 of the housing 22, the sidewalls extending upwardly from the floor 26 and terminating at an upper end to define an upper open end 29 of the housing 22.

As shown in FIG. 1, the floor 26 of the housing 22 has a nozzle receptacle 30 in the form of an opening or aperture that receives a nozzle 32 of the container 14. The nozzle 32 may be coupled to a valve or valve stem (not shown) or other device that is biased or spring loaded so that the valve remains closed until the nozzle 32 is depressed or actuated. Such valve assemblies for use with pressurized or aerosol canisters are well known to those skilled in the art. A head piece 34 may be formed in the floor 26 and extend upward from the floor 26. In such cases the head piece 34 may be molded with or otherwise be integral with the floor 26 or housing 22. In other embodiments, the head piece 34 may be provided separately with and/or formed as part of or provided with the nozzle 32 of the container 14. The head piece 34 includes a channel and orifice 36 for discharging product from the nozzle 32 into the reservoir 24. A seal or seals (not shown), which may be formed from a rubber or elastomeric material, may be used to seal any gap between the nozzle receptacle 30 and the nozzle 32 to prevent leakage of liquid through or from the nozzle receptacle 30 out of the reservoir 24.

As shown, the area of the floor 26 surrounding the nozzle receptacle 30 may define a collar that engages or rests on a shoulder 38 of the nozzle 32. This allows the nozzle 32 to be depressed by depressing the housing 22, which pivots about hinge 23, to open the valve (not shown) of the container 14 to discharge the pressurized contents of the container 14. A finger or thumb rest 40 may also be formed with or be provided with the housing 22 to facilitate depressing the housing 22 to open the valve of the container 14. The finger rest 40 is located exterior to the reservoir 24, as shown, and may have a recessed and knurled or textured surface to provide non-slip engagement.

Figure 2:
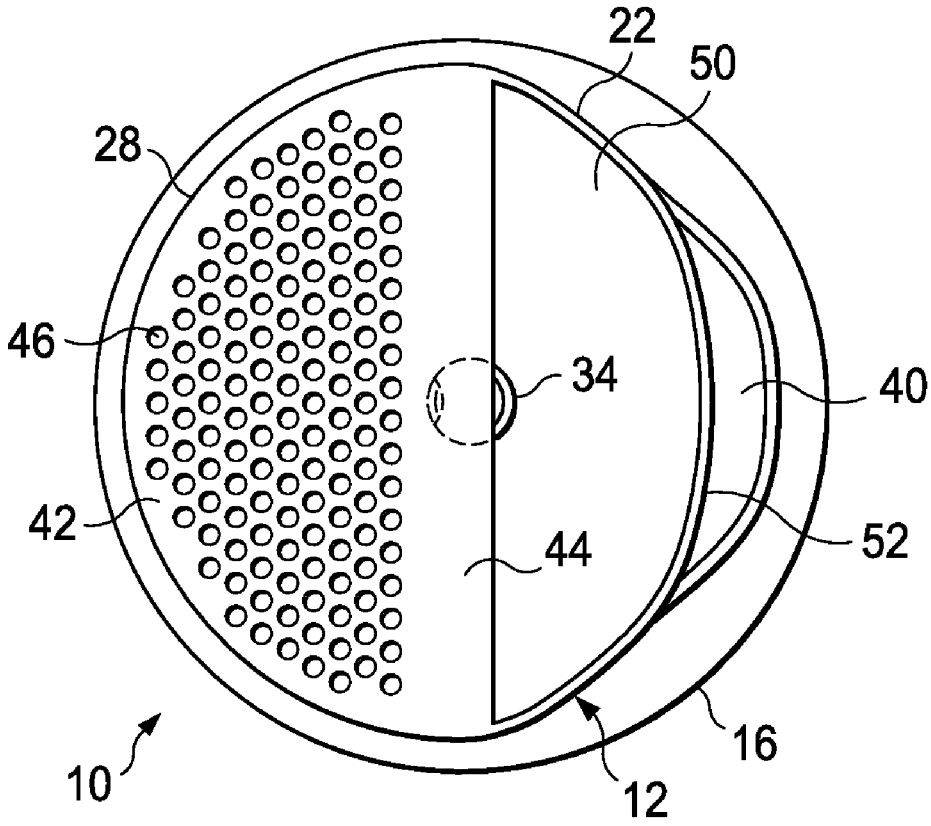
FIG. 2 is a top plan view of the device of FIG. 1.

A strainer 42 is provided with the discharge assembly 12. The strainer 42 is formed by wall 44 that extends across the open end 29 of the housing 22 defined by the terminating upward extending sidewalls 28. As shown in FIG. 2, the wall 44 only extends across a portion of the opening defined by the sidewalls 28 and is coupled or joined along its outer perimeter to the sidewalls 28. As shown, the wall 44 may be generally semi-circular in shape, although other shapes and configurations may be used as well. The wall 44 is provided with one or more apertures 46 that extend through the thickness of the wall 44. In the embodiment shown, a plurality of spaced apart apertures 46 are provided in the wall 44 so that the apertured wall 44 essentially forms a screen or sieve. As is discussed more fully later on, the apertures 46 are sized and configured to prevent the passage of the discharged product through the aperture 46. The apertures 46 may be of any transverse cross-sectional shape, such as circular, oval, rectangular, square, polygonal, etc. They may be formed as elongated slots or slits, which may be straight or arcuate, zigzagged or undulated. In the embodiment shown, the apertures 46 are generally circular in transverse cross section. A suitable diameter may be from about 1 mm to 2 mm or more. The wall 44 forming the strainer 42 may be integrally formed or permanently fixed to the housing 22. In other embodiments, the strainer wall 44 may be releasable from the housing 22 or may be pivotally mounted to the housing so that the wall 44 may be removed or pivoted out of the way from the open end of the housing 22. This may facilitate cleaning of or access to the reservoir 24.

A dam or retaining wall 48 may optionally be provided along the innermost edge of the strainer 42 that projects inward into the reservoir and extends across the open end 29 of the housing 22 to facilitate retaining of the discharged product within the reservoir 24 during separation of the warming liquid, as will be described later on.

An access port 50 is provided with the housing 22. The access port 50 is formed by the open end 29 of the housing 22 that is not covered by the strainer 42. The access port 50 may be any size that allows the removal of the discharged product from the reservoir. In certain embodiments the access port 50 may be from about 0.5 $in^2$ to about 1 $in^2$ or about 1.5 $in^2$ greater in area to facilitate removal of the discharged product therethrough. In other embodiments, the access port 50 may be less than about 0.5 $in^2$ In still other embodiments, the strainer 42 may cover the entire open end 29 of the housing 22, so that the access port 50 is only provided upon removal or pivoting of the strainer 42 out of the way, thus allowing the discharged product to be accessed and removed from the reservoir 24.

As shown in FIG. 1, the sidewalls 28 surrounding semi-circular strainer wall 44 are generally upright and semi-cylindrical in shape. The sidewalls 28 surrounding the outer perimeter of the access port 50, however, are configured so that they expand radially outward towards the upper end. This also provides an undercut area that accommodates the finger rest 40, as shown. Additionally, the sidewalls 28 surrounding the access port 50 may be curved and converge together to form a lip or mouth 52 of the access port 50 to facilitate pouring and removal of the discharged product from the reservoir. In certain embodiments the access port may be configured as a tubular or enclosed spout (not shown) sized to facilitate pouring of the product out of the reservoir 24.

An optional cover or cap 54 may also be provided with the device 10. The cap 54 may be generally cylindrical in shape with a generally flat upper surface 56 and is configured for positioning over and covering the discharge assembly 12. The cap 54 may secure to the discharge assembly 12 or to the container 14, such as through a friction or snap-fit. This protects the discharge assembly 12, such as during storage and transportation, and also provides an appearance to the device 10 that is similar to conventional canisters of shaving cream or gel. The flat upper surface 56 also allows the devices 10 to be stacked on one another, such as during storage, transportation or display.

In use, the cap 54 is removed to access the discharge assembly 12 and dispense a product. In an exemplary method, the container 14 contains a shaving gel or lotion product used in shaving. With the cap 54 removed, a user then depresses the finger rest 40 of the housing 22 so that the nozzle 32 is depressed to actuate the container valve and discharge the contents of the container 14 through the orifice 36 of the nozzle head piece 34. The nozzle 32 and/or the head piece 34 may be configured to provide a thin stream of product or gel that is discharged into the reservoir. Such a stream of product may have a width or diameter of from less than about 1.5 mm to about 3 mm, 4 mm, 5 mm or more. A regulator, which may include a stop that engages the housing 22 so that it can only be depressed a certain amount, may also be provided with the discharge assembly 12 or device 10 so that the amount of product discharged is controlled so that it is only discharged in a thin stream. Providing the discharged product in a thin stream facilitates increased and rapid warming of the discharged product than occurs when the product is discharged in a larger stream or mass. As will be discussed later on with respect to the other embodiments, a small tube or conduit may also be provided for directing the product into the reservoir and to facilitate the forming of a thin product stream. It should be noted, however, that sufficient warming of the product may still occur even when the product is discharged in larger streams or masses.

A warming liquid is introduced into the reservoir 24. The warming liquid is typically warm water from a household faucet or tap, such as the faucet of a bathroom sink. Other liquids may also be used that are aqueous or non-aqueous. The typical hot water temperature from such household faucets may be from less than about 100° F. (37.8° C.) to about 130° F. (54.4° C.) or more, depending upon the temperature of water from the water heater and the amount of heat transfer that occurs during the flow of water from the water heater to the faucet. The warm water or liquid is introduced through the open end 29, either through the strainer portion 42 or access port 50 or both. The warming water or liquid may be introduce into the reservoir prior to, during and/or after the product has been discharged into the reservoir 24.

Upon warming of the discharged product or gel, the warming water or liquid is separated from the product. This is accomplished by tilting the device 10 so that a majority to substantially all of the water or liquid in the reservoir 24 is poured out of the reservoir 24 from the open end 23 of the discharge housing 22. The strainer 42 facilitates retaining the gel or discharged product within the reservoir 24, with the apertures 46 being sized to prevent the passage of the gel or discharged product therethrough. The gel or discharged product is typically substantially more viscous than the water or warming liquid such that the product does not readily pass through the apertures 46. Additionally, the gel or product is of a consistency such that the product does not substantially degrade immediately upon contact with the warm liquid or water. As used herein, the term "degrade" with respect to the discharged product is meant to encompass the dissolving or dispersing of the product within the water or warming liquid such that a substantial portion of the product is capable of being poured through the apertures 46 along with the warming liquid during its separation.

When the warming water or liquid is separated, the gel or product is removed from the reservoir 24 through the access port 50. This may be accomplished by tilting the device 10 in the opposite direction from the strainer 42 so that the product is poured out of the access port 50. Additionally, the port 50 may also be sized to permit the user to insert one or more fingers into the reservoir 24 so that the warmed product or gel may be removed manually with the user's fingers. The product may then be applied to the user's skin or areas where the warmed product is desired.

If desired, the reservoir 24 may be rinsed or cleaned after use by introducing water or a cleansing fluid or liquid into the reservoir in the same manner that the warming liquid is introduced and then poured out of the reservoir through the access port and/or strainer.

Figure 3:
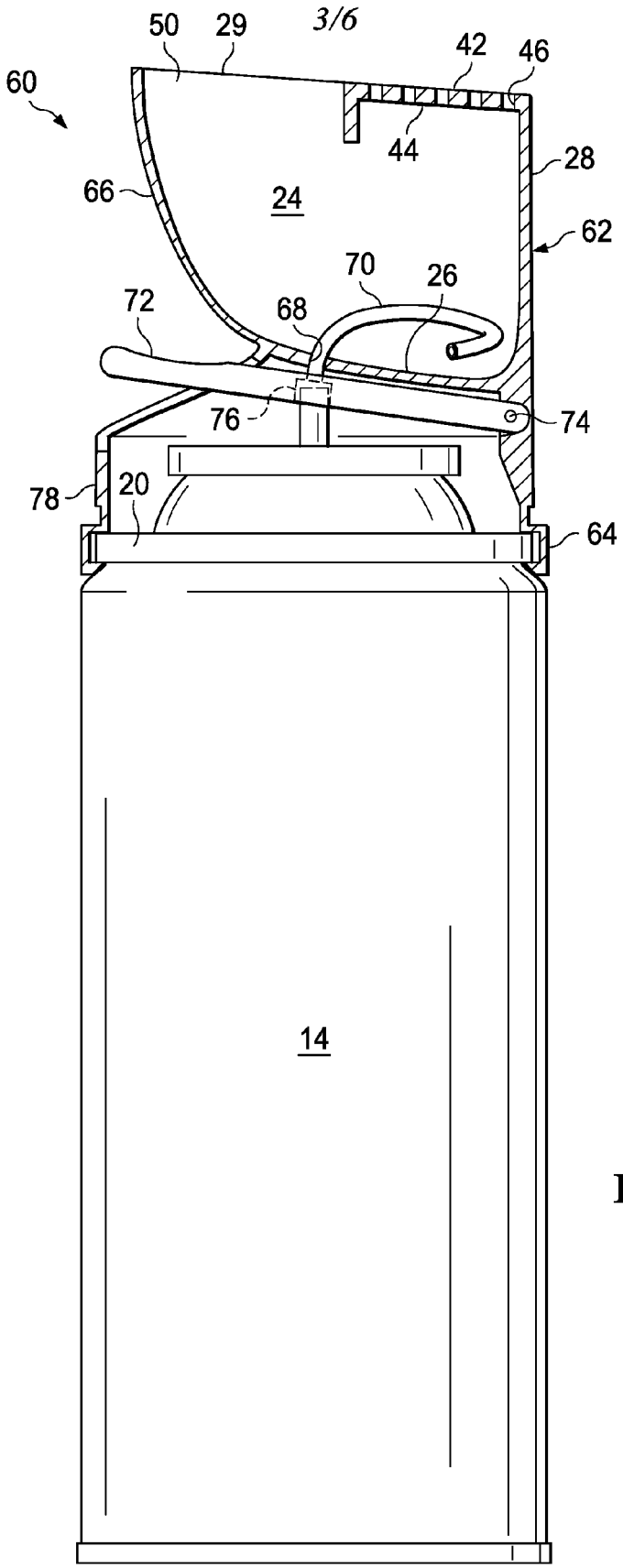
FIG. 3 is an elevational side view of another embodiment of device for dispensing and warming a product dispensed form the device.
Figure 4:
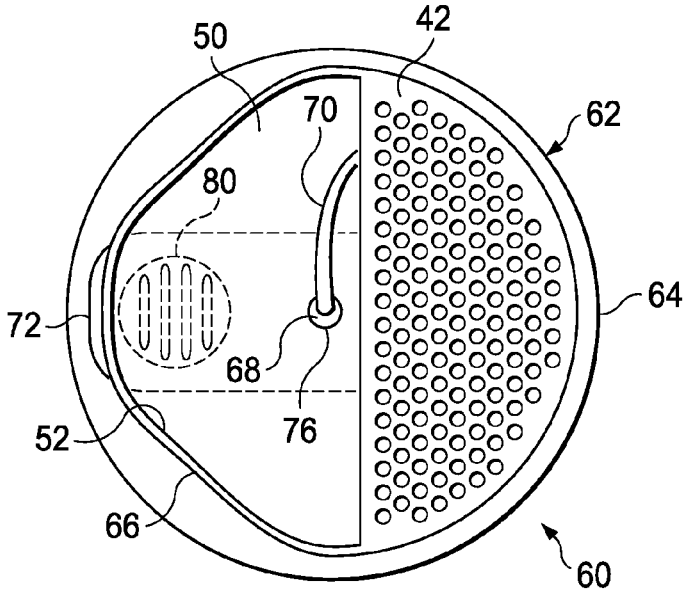
FIG. 4 is a top plan view of the device of FIG. 3.

FIGS. 3 and 4 show another embodiment of a device 60 for dispensing and warming a product. The device 60 is similar to the device 10 previously described, with the same reference numerals designating similar components. The products dispensed from the device 60 may be the same or similar to those described for the device 10. The device 60 includes a discharge assembly 62 that is includes a container engagement portion 64 similar to the engagement portion 16 that is configured to secure and engage the upper end of the container 14.

The discharge assembly 62 also includes a discharge housing 66. The discharge housing 66 is fixedly coupled to the engagement portion 64 but is otherwise similar to the housing 22 of the device 10, previously described, and may be molded or formed as a single unitary piece or as separate components.

The floor 26 of the housing 66 is provided with an aperture 68 to receive a length of tubing 70. The tubing 70 is connected at one end to the nozzle 32 of the container 14 and facilitates directing the discharged product from the nozzle 32 to the reservoir 24 of the housing 66. The tubing may be of a rubber or elastomeric material that provides a seal between the perimeter of the aperture 68 and the exterior of the tubing so that no leakage out of the reservoir 24 occurs through the floor 26. If necessary, additional seals or other mechanisms may be provided to seal the floor 26 of the housing 66 to prevent leakage. The tubing 70 may be sized and configured to provide a thin stream of the discharge product, as previously described. Additionally, the tubing 70 may be generally rigid or it may have a degree of flexibility. If the tubing 70 is provided with a degree of flexibility the free end may move or oscillate within the reservoir 24 to a degree when the product is being discharged through the tubing 70. This may allow the discharged product to be further dispersed within the reservoir 24, which may also facilitate more effective heat transfer. The length of the tubing 70 may be from less than 0.5 inch to 1.5 inch or more. The tubing may also be molded or integral with the housing 66 or configured as a channel or flow path formed in the housing 66.

A lever 72 is provided with the discharge assembly 62. The lever member 72 locates below the floor 26 of the housing 66 and is pivotally coupled to the housing 66 at one end through a hinge 74, which may be a mechanical hinge or may be provided through flexibility of materials. The midsection of the lever 72 is provided with an aperture 76 (FIG. 4) that receives and may allow the tubing 70 from the nozzle 32 to movably pass therethrough without binding. In other embodiments, the tubing 70 may be secured within the aperture 76 with a sufficient amount of length or flexibility to provide an amount of play to accommodate movement when the lever 72 is moved. The midsection of the lever 72 is provided with a nozzle engagement portion or receptacle 78 that contacts or otherwise engages the nozzle 32 so that the nozzle 32 is depressed upon depressing the lever 72 to discharge the product within the container 14. A thumb or finger rest 80 is provided at the opposite end of the lever 72, the surface of which may be slightly recessed and textured or knurled to provide a non-slip surface.

The operation of the device 60 is similar to the device 10. Gel or product is discharged into the reservoir 24 by depressing the lever 72 so that the nozzle 32 is opened and the product passes through the tubing 70 into the reservoir 24. Warm water or liquid is introduced into the open upper end 29 of the housing 66 and separated through strainer 42 after the gel or product is warmed. The gel or product is then removed through access port 50 for use.

Figure 7:
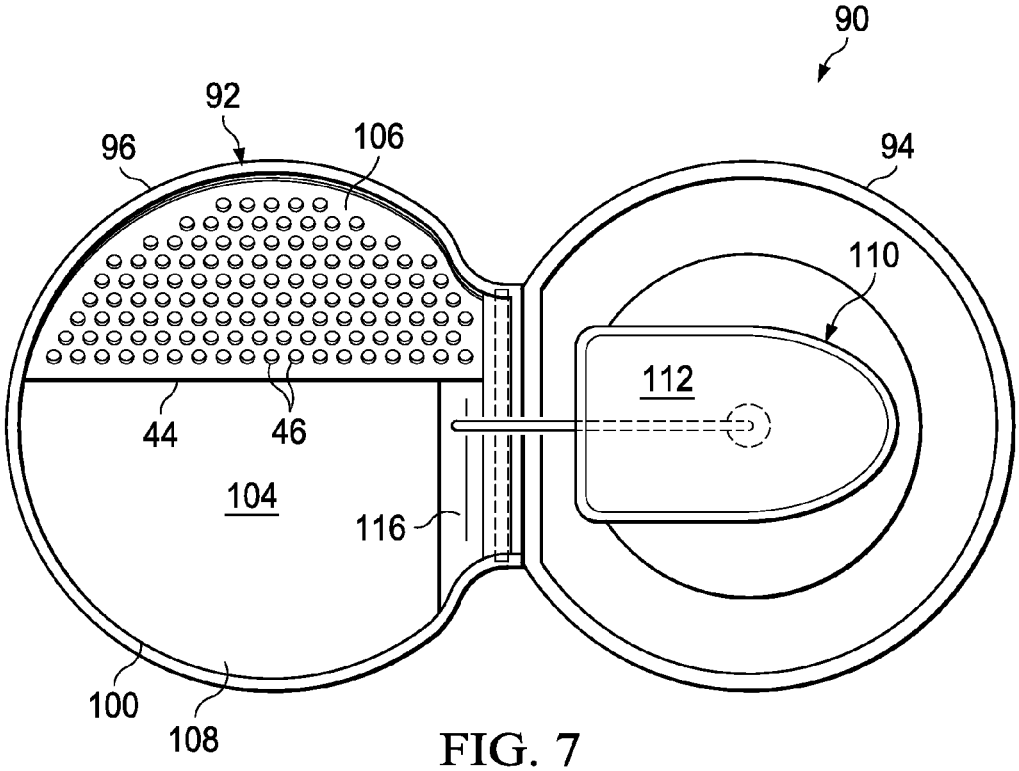
FIG. 7 is a top plan view of the device of FIG. 6, shown with the housing of the discharge assembly in the open position.
Figure 5:
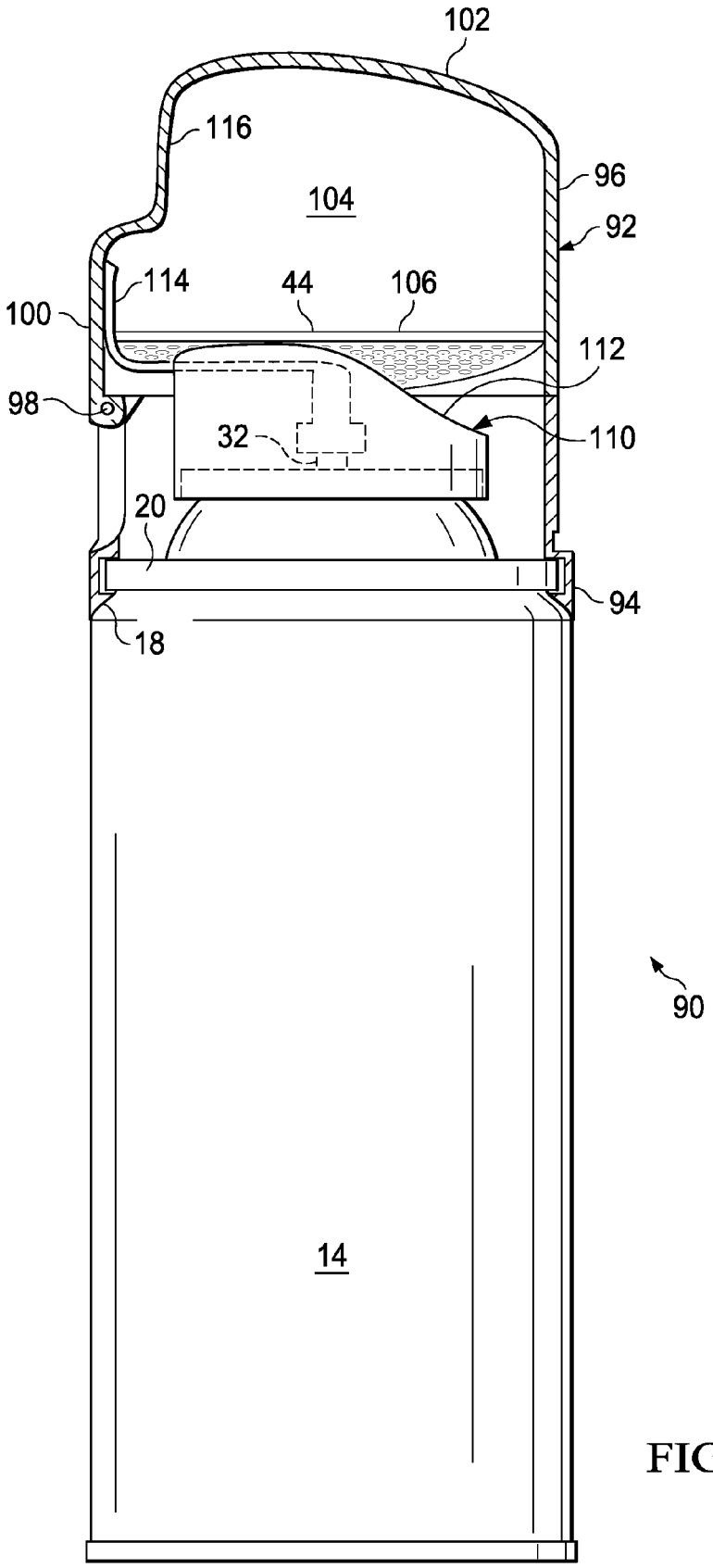
FIG. 5 is an elevational side view of a third embodiment of a device for dispensing and warming a product dispensed form the device, shown with a housing of a discharge assembly of the device in a closed position.
Figure 6:
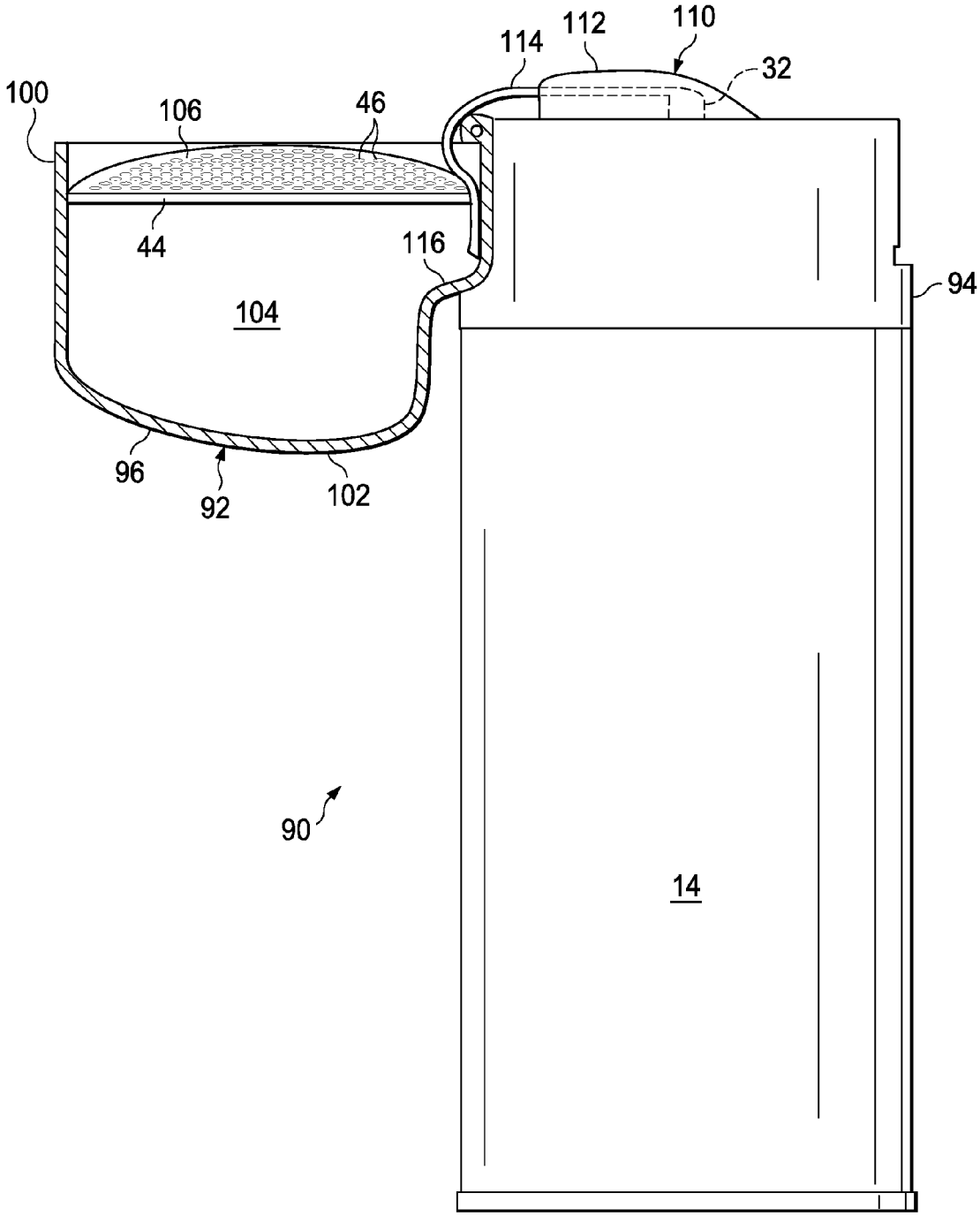
FIG. 6 is an elevational side view of the device of FIG. 5, shown with the housing of the discharge assembly in an open position.

FIGS. 5-7 show still another embodiment of a device 90 for dispensing and warming a product. The device 90 may employ the same container 14 as previously described. The device 90 includes a discharge assembly 92 that is coupled to the container through a container engagement portion 94, which may be similar to those previously described. A housing 96 is coupled to the engagement portion 94 and is pivotally attached to the engagement portion 94 through hinge 98. The hinge 98 may be a mechanical hinge or may be formed from flexibility of materials of the portion 94 and housing 96.

Referring to FIG. 6, which shows the housing 96 in an open position, the housing 96 is similar in configuration to the housing bodies previously described and includes sidewalls 100 that are joined together by a floor 102 to form a reservoir 104. A strainer 106 and an access port 108, which may be similar to those previously described, are provided in the open upper end of the housing 96.

The container 14 is provided with a nozzle assembly 110 that includes a nozzle 32, a headpiece or nozzle actuator button 112 for depressing the nozzle to actuate the valve of the container 14, and a length of tubing 114 that is coupled to the nozzle 32 for directing product into the reservoir 104 of the housing 96. As shown in FIG. 6, the tubing may be attached, such as through adhesive, spot welding, or other fastening means, at the opposite end to the inner sidewall 100. A lateral shelf or step 116 may be formed into the hinged sidewall 100 with the end of the tubing 114 terminating immediately above the shelf 116. In this way product discharged tubing will contact the shelf 116 and be directed laterally into the interior of the reservoir 104. This may facilitate dispersion of the product into the reservoir 104 to thereby increase heat transfer to the discharged product.

As shown in FIG. 5, when the housing 96 is in the closed position, the housing 96 is inverted and encloses the top of the container 14 and the nozzle assembly 110. This protects the nozzle assembly 110 so that the nozzle cannot be unintentionally actuated. This also facilitates storage and shipment of the device 90. In certain embodiments, the outer surface of the floor 102 may be a generally flat surface that provides a generally level surface in the device 90 is closed and in an upright position to facilitate stacking and storing of the devices 90. When in the closed position, the strainer may be positioned above the nozzle assembly 110 or at a position where sufficient clearance of the nozzle assembly 110 is provided.

In use, the housing 96 is moved from the closed position of FIG. 5 to the open position, as shown in FIGS. 6 and 7, by pivoting the housing 96 about the hinge 98. The nozzle actuator button 112 is then depressed so that gel or product is discharged from the container 14 through the tubing 114 and into the reservoir 104. Warm water or liquid is introduced into the open end of the housing 96 to warm the gel or product within the reservoir 104. After a length of time, the warm water or liquid is separated from the discharged product by tilting the device 90 so that the water or liquid drains from the reservoir 104 through the strainer 106 while the warmed, discharged product remains in the reservoir 104. The warmed product is then removed through the access port 108.

It should be noted that the discharge assemblies described herein may be provided preassembled with the containers for which they are used. In other embodiments the discharge assembly may be secured and used with a conventional preexisting container of shaving gel or other product, wherein the end user removes the preexisting end cap and/or nozzle actuator and couples the discharge assembly to the nozzle of container. In other embodiments, the discharge assembly may not couple to the container or canister, but may be configured for use as a separate component, wherein the product is dispensed from the container into the discharge assembly, which may be free standing, held in the hand or otherwise used without being coupled to the container. In such instances, the discharge assembly may be configured similarly to the discharge assembly 92, but without being coupled to the container 14. Other configurations may be used as well, however.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

I claim:

1. A method of heating a product dispensed from a handheld container having a nozzle for discharging the product from the container, the method comprising:

(a) providing a discharge assembly that is coupled to the container, the discharge assembly having a discharge housing that defines a reservoir and is in fluid communication with the nozzle for receiving the discharged product from the nozzle and collecting the discharged product within the reservoir, the upper end of the discharge housing having a strainer and a product access port formed therein;

(b) introducing a warm liquid into the reservoir of the discharge housing;

(c) discharging an amount of product from the container into the reservoir by manually actuating the nozzle, the discharged product being at a temperature below that of the warm liquid, and allowing the discharged product to mix with the warm liquid, the discharged product being of a consistency such that the discharged product does not substantially degrade immediately when in contact with the warm liquid;

(d) allowing the discharged product to be warmed by the warm liquid;

(e) separating the warm liquid from the discharged product by pouring out at least a majority of the warm liquid from the discharge housing through the strainer, the strainer being configured so that at least a majority of the discharged product is retained within the reservoir after pouring out the liquid; and then (f) removing the discharged product through the product access port of the housing.

2. The method of claim 1, wherein:

the discharge assembly is coupled to the container.

3. The method of claim 1, wherein:

the product consists of shaving gel or lotion.

4. The method of claim 1, wherein:

the product access port comprises an opening in the housing of about 0.5 $in^2$ or greater.

5. The method of claim 1, wherein:

the strainer comprises a wall having an aperture formed therein sized to prevent the passage of the discharged product through the aperture.

6. The method of claim 5, wherein:

there are a plurality of apertures.

7. The method of claim 1, wherein:

the discharge housing is pivotally coupled to the container.

8. The method of claim 1, wherein:

the discharge assembly includes a removable cover that selectively covers the discharge housing.

9. The method of claim 1, wherein:

the discharge housing has a nozzle receptacle that receives the nozzle and facilitates directing the discharged product into the reservoir.

10. The method of claim 1, wherein:

wherein the nozzle is actuated by depressing the discharge housing.

11. The method of claim 1, wherein:

the discharge assembly includes a lever that engages the nozzle, the nozzle being actuated by depressing the lever.

12. The method of claim 1, wherein:

steps (b) and (c) are performed in any order or simultaneously.

13. The method of claim 1, wherein:

the warm liquid is introduced through at least one of the strainer and the product access port of the discharge housing.

14. An assembly for use in heating a product dispensed from a handheld, self-contained container having a nozzle for discharging product from the container, the assembly comprising a discharge housing that defines a reservoir and is in fluid communication with the nozzle, the reservoir receiving the discharged product from the nozzle and collecting the discharged product within the reservoir, and allowing the introduction of a warm liquid into the reservoir;

a strainer that allows the warm liquid introduced into the reservoir of the discharge housing to be separated from the discharged product by pouring the warm liquid from the discharge housing through the strainer, the strainer being configured so that at least a majority of the discharged product is retained within the reservoir after pouring out the liquid; and a product access port that allows the discharged product to be removed from the reservoir through the product access port of the housing.

15. The assembly of claim 14, further comprising:

a container engagement portion configured for engaging and coupling the assembly to the container.

16. The assembly of claim 14, wherein:

the strainer comprises a wall of the discharge housing having an aperture formed therein sized to prevent the passage of the discharged product through the aperture.

17. The assembly of claim 16, wherein:

there are a plurality of apertures.

18. The assembly of claim 14, wherein:

the discharge housing pivotally couples to the canister.

19. The assembly of claim 14, further comprising:

a removable cover that selectively covers the discharge housing.

20. The assembly of claim 14, wherein:

the discharge housing has a nozzle receptacle that receives the nozzle to facilitate directing the discharged product into the reservoir.

* * * * *